US010036237B2

(12) United States Patent
O'Brien et al.

(10) Patent No.: US 10,036,237 B2
(45) Date of Patent: Jul. 31, 2018

(54) MECHANICALLY-SET DEVICES PLACED ON OUTSIDE OF TUBULARS IN WELLBORES

(71) Applicants: Robert S. O'Brien, Katy, TX (US); Emily A. Hanson, Conroe, TX (US)

(72) Inventors: Robert S. O'Brien, Katy, TX (US); Emily A. Hanson, Conroe, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 170 days.

(21) Appl. No.: 14/219,856

(22) Filed: Mar. 19, 2014

(65) Prior Publication Data

US 2015/0267498 A1 Sep. 24, 2015

(51) Int. Cl.
*E21B 43/26* (2006.01)
*E21B 34/14* (2006.01)

(52) U.S. Cl.
CPC ..... *E21B 43/26* (2013.01); *E21B 34/14* (2013.01)

(58) Field of Classification Search
CPC ..... E21B 43/26; E21B 34/14; E21B 33/128; E21B 33/00; E21B 33/12
See application file for complete search history.

(56) References Cited

U.S. PATENT DOCUMENTS 1,797,177 A * 3/1931 Nixon ..... E21B 23/06 166/143
5,197,547 A 3/1993 Morgan
5,988,271 A 11/1999 ONeal et al.
6,241,013 B1 * 6/2001 Martin ..... E21B 43/267 166/114
6,830,104 B2 * 12/2004 Nguyen ..... E21B 43/08 166/227
2006/0124295 A1 6/2006 Maguire
2012/0325499 A1 12/2012 Moffitt

FOREIGN PATENT DOCUMENTS

WO 20111028560 A2 3/2011

OTHER PUBLICATIONS

Dictionary definition of "attach", accessed on Jun. 25, 2016 via www.thefreedictionary.com.*
PCT International Search Report and Written Opinion; International Application No. PCT/US2015/016291; International Filing Date: Feb. 18, 2015; dated May 29, 2015; pp. 1-17.

* cited by examiner

*Primary Examiner* — David J Bagnell
*Assistant Examiner* — Manuel C Portocarrero
(74) *Attorney, Agent, or Firm* — Cantor Colburn LLP

(57) ABSTRACT

In one aspect, a device for use in a wellbore is disclosed that in one non-limiting embodiment includes a body having an outer surface and a bore therethrough, an element on the outer surface of the body that expands radially outward from the body, a movable sleeve on the outer surface of the body that expands the element when pushed against the element, and an attachment device connected to an inside surface of the movable sleeve and accessible from inside the body so that the attachment member may be moved from inside the body to move the sleeve to set the device.

18 Claims, 2 Drawing Sheets

MECHANICALLY-SET DEVICES PLACED ON OUTSIDE OF TUBULARS IN WELLBORES

BACKGROUND

1. Field of the Disclosure

This disclosure relates generally to completion and production strings deployed in wellbores for the production of hydrocarbons from subsurface formations, including completion strings deployed for fracturing, sand packing, flooding and the production of hydrocarbons.

2. Background of the Art

Wellbores are drilled in subsurface formations for the production of hydrocarbons (oil and gas). Modern wells can extend to great well depths, often more than 15,000 ft. Hydrocarbons are trapped in various traps or zones in the subsurface formations at different wellbore depths. Such zones are referred to as reservoirs or hydrocarbon-bearing formations or production zones. Strings containing various devices are deployed in the wellbore for treatment operations, such as fracturing (also referred to as fracing or fracking), sand packing, flooding and for the production of hydrocarbons over the life of the wells. Packers are commonly placed at various locations on strings to isolate zones for treatment of zones and to produce fluids from such zones. For example, in a multi-zone well, a packer above and a packer below each zone may be used to isolate such zone from the remaining zones. Packers typically include a number of circumferentially disposed packer elements around a tubular member or a packer body, which elements when expanded radially from the packer body press against and clamp onto the wellbore wall or the casing. Packers typically are either hydraulically-set packers or mechanically-set packers. Hydraulically-set packers typically include valves and require pressuring the well to set such packers. Mechanically-set packers include a sleeve on the outer side of the packer body that when pushed sets the packer elements. Such mechanical packers are set or deployed by conveying a running tool into the wellbore to apply force directly onto the sleeve located on the outside of the packer body. The sleeve slides along the outside of the packer body to radially expand the packer elements and set the packer inside the well or the casing, as the case maybe. In some strings, such as strings used for fracing and sand packing, the outside of the packer is not accessible and, thus, load or force cannot be applied onto the sleeve on the outside of the packer by a running tool to set the packer.

The disclosure herein provides strings for use in wellbores that include one or more mechanically-set packers that may be set or deployed from inside the packer body.

SUMMARY

In one aspect, a packer is disclosed that in one non-limiting embodiment includes a packer body having an outer surface and a bore therethrough, a packer element on the outer surface of the packer body that expands radially outward from the packer body, a movable sleeve on the outer surface of the packer body that expands the packer element when pushed against the packer element, and an attachment device connected to an inside surface of the movable sleeve and accessible from inside the packer body so the attachment member may be moved from inside the packer body to move the sleeve to set the packer.

In another aspect, a method of treating a zone in a wellbore is disclosed that in one non-limiting embodiment includes: conveying an assembly in the wellbore that includes a plurality of production sections, wherein each production section includes at least one packer and wherein each such packer includes a packer body having an outer surface and a bore therethrough, a packer element on the outer surface of the packer body configured to expand radially outward from the packer body, a movable sleeve on the outer surface of the packer body that expands the packer element when pushed against the packer element; and setting the packer by moving the attachment device by a running tool conveyed from a surface location to move the packer element radially outward.

Examples of the more important features of the apparatus and methods disclosed herein are summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
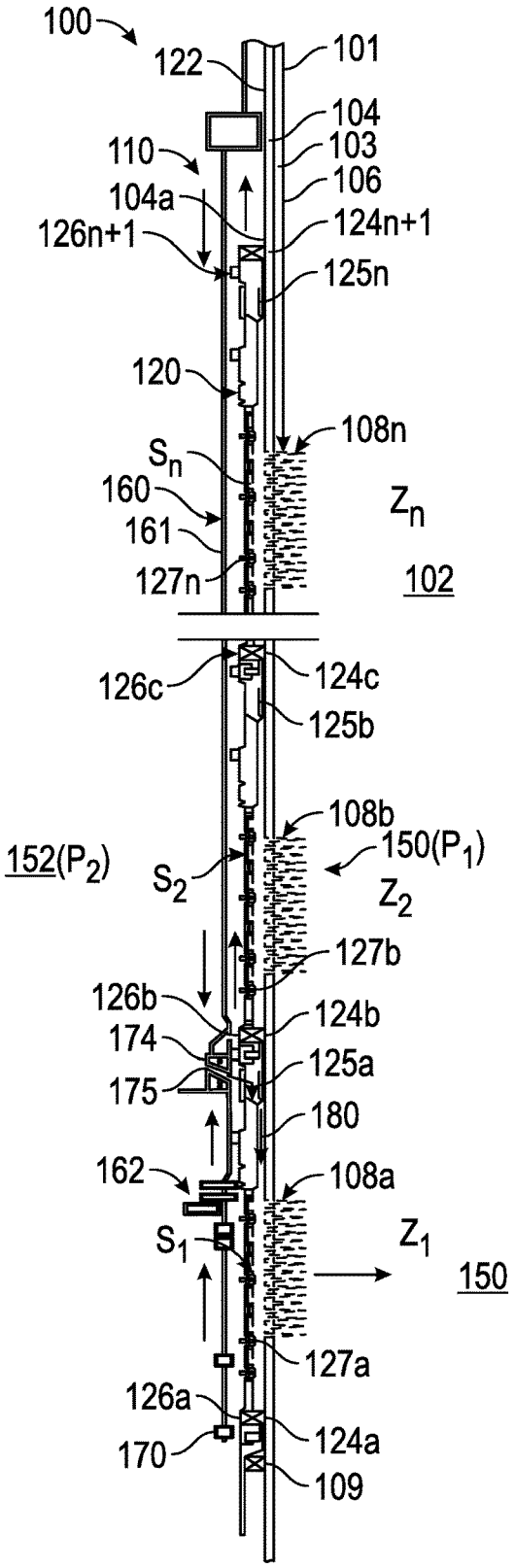
FIG. 1 shows an exemplary cased-hole multi-zone wellbore containing a production string that includes a number of packers made according to one embodiment of the disclosure.

FIG. 1 is a line diagram of a section of a wellbore system 100 that is shown to include a wellbore 101 formed in formation 102 for performing a treatment operation therein, such as fracturing the formation (also referred to herein as fracing or fracking), gravel packing, flooding, etc. The wellbore 101 is lined with a casing 104, such as a string of jointed metal pipes sections, known in the art. The space or annulus 103 between the casing 104 and the wellbore 101 is filled with cement 106. The particular embodiment of FIG. 1 is shown for selectively fracking and gravel packing one or more zones in any selected or desired sequence or order. However, wellbore 101 may be configured to perform other treatment or service operations, including, but not limited to, gravel packing and flooding a selected zone to move fluid in the zone toward a production well (not shown). The formation 102 is shown to include multiple production zones (or zones) Z1-Zn that may be fractured or treated for the production of hydrocarbons therefrom. Each such zone is shown to include perforations that extend from the casing 104, through cement 106 and to a certain depth in the formation 102. In FIG. 1, Zone Z1 is shown to include perforations 108*a*, Zone Z2 perforations 108*b*, and Zone Zn perforations 108*n*. The perforations in each zone provide fluid passages for fracturing each such zone, as shown by arrows 180. The perforations also provide fluid passages for formation fluid 150 to flow from the formation 102 to the inside 104*a* of the casing 104. The wellbore 101 includes a sump packer 109 proximate to the bottom 101*a* of the wellbore 101. After casing, cementing, perforating and sump packer deployment, the wellbore 101 is ready for treatment operations, such as fracturing and gravel packing of each of the production zones Z1-Zn. The fluid 150 in the formation 102 is at a formation pressure (P1) and the wellbore 101 is filled with a fluid 152, such as completion fluid, which fluid provides hydrostatic pressure (P2) inside the wellbore 101. The hydrostatic pressure P2 is greater than the formation pressure P1 along the depth of the wellbore 101, which prevents flow of the fluid 150 from the formation 102 into the casing 104 and prevents blow-outs.

Still referring to FIG. 1, to treat (for example to fracture) one or more zones Z1-Zn, a system assembly 110 is run inside the casing 104. In one non-limiting embodiment, the system assembly 110 includes an outer string 120 and an inner string 160 placed inside the outer string 120. The outer string 120 includes a pipe 122 and a number of devices associated with each of the zones Z1-Zn for performing treatment operations described in detail below and for producing formation fluid 150 thereafter. In one non-limiting embodiment, the outer string 120 includes a lower packer 124*a*, an upper packer 124*m* and intermediate packers 124*b*, 124*c*, etc. The lower packer 124*a* isolates the sump packer 109 from hydraulic pressure exerted in the outer string 120 during fracturing and sand packing of the production zones Z1-Zn. In this case the number of packers in the outer string 120 is one more than the number of zones Z1-Zn. In some cases, the lower packer 109, however, may be utilized as the lower packer 124*a*. In one non-limiting embodiment, some or all the packers may be internally-set mechanical packers, as described in more detail in reference to FIGS. 2 and 3 that may be independently or selectively set or deployed in any order. The outer string 120 further includes a screen adjacent to each zone. For example, screen S1 is shown placed adjacent to zone Z1, screen S2 adjacent to zone Z2 and screen Sn adjacent to zone Zn for controlling sand during production of formation fluid 150. To treat a zone, such zone is isolated from other zones. In the system 100, the lower packer 124*a* and intermediate packer 124*b*, when deployed, will isolate zone Z1 from the remaining zones: packers 124*b* and 124*c* will isolate zone Z2 and packers 124*n* and 124*n*+1 will isolate zone Zn. In the particular configuration of string 100, the numbers of packers is one more than the number of zones. In one non-limiting embodiment, as described in detail later, each packer 124*a*-124*n*+1 may include an associated packer setting mechanism or setting device so that such packers may be deployed from inside 120*a* of the outer string 120. In FIG. 1, a mechanical setting device 126*a* is associated with packer 124*a*, device 126*b* with packer 124*b*, device 126*c* with packer 124*c* and device 126*n*+1 with packer 124*n*+1 that allows its associated packer to be mechanically deployed from inside of the outer string 120.

Figure 2:
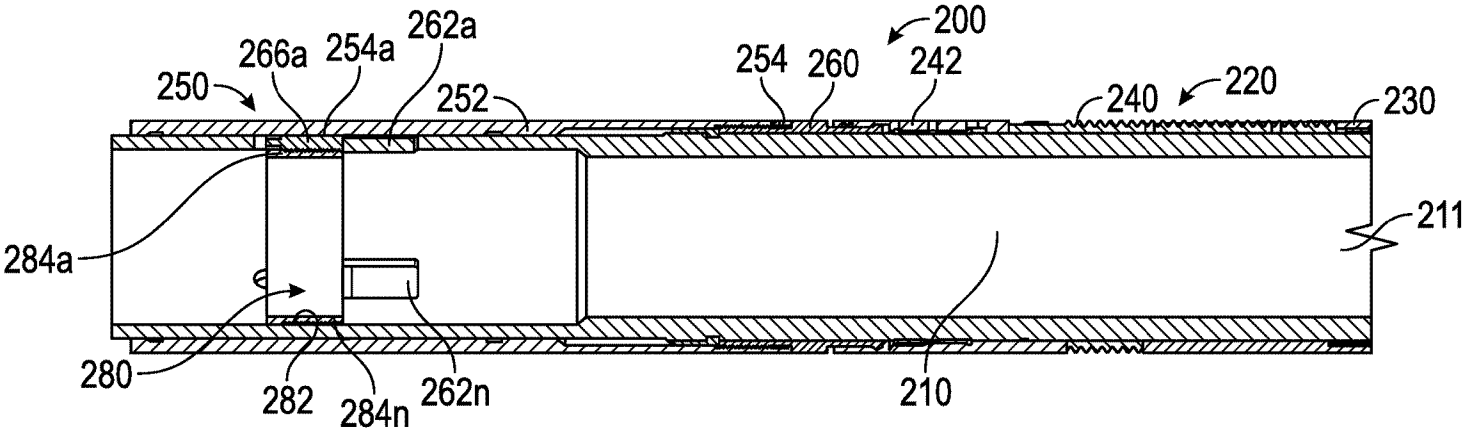
FIG. 2 shows a cross-section of a non-limiting embodiment of a mechanically-set packer in a run-in position (non-deployed state), according to one embodiment of the disclosure.
Figure 3:
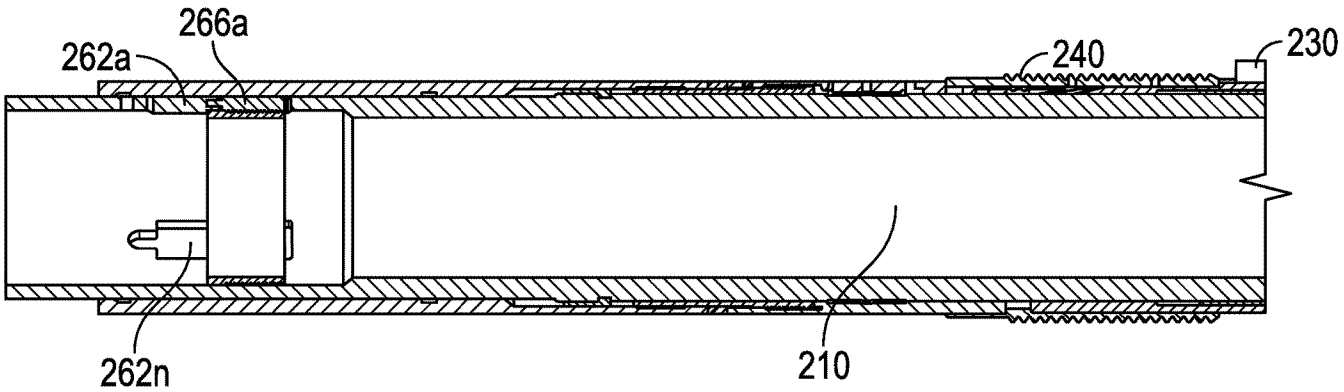
FIG. 3 shows the cross-section of the packer shown in FIG. 2 after the packer has been mechanically set by a running tool.

Still referring to FIG. 1, the inner string 160 (also referred to herein as the service string) includes a tubular member 161 that carries a number of tools 162 (commonly referred to as shifting tools and running tools) for setting the inner string 160 inside the outer string 120 at selected locations, opening and closing various devices, such as valves, and a running tool 170 for setting the packers 124-124*n*+1 from inside the outer string 120 by latching onto the setting devices 126*a*-126*n*+1, as described in more detail in reference to FIGS. 2 and 3. The inner string 160 further includes a cross-over tool 174 (also referred to in the art as a "frac port") for supplying a treatment fluid, such as slurry that includes water and sand, via a fluid path 175 to the perforations in each zone as shown by arrows 180.

Still referring to FIG. 1, the outer string 120 further includes a screen between the packers that isolate the zone. In FIG. 1, screens S1-Sn correspond respectively to zones Z1-Zn. The outer string 120 also includes, above each screen, a flow control device, referred to as a slurry outlet or a gravel exit, which may be a sliding sleeve valve or another valve, to provide fluid communication between the inside 120*a* of the outer string 120 and each of the zones Z1-Zn. As shown in FIG. 1, a slurry outlet 125*a* is provided for zone Z1 between screen S1 and its intermediate packer 124*b*, slurry outlet 125*b* for zone Z2 and slurry outlet 125*n* for zone Zn. A valve 127*a* associated with screen S1, valve 127*b* associated with screen S2 and valve 127*n* associated with screen Sn are provided to allow flow of the formation fluid 150 from the formation 102 into the outer string 120. The outer string 120 is run into the wellbore 101 with the slurry outlets 125*a*-125*n* and the flow devices 127*a*-127*n* closed. The slurry outlets 125*a*-125*n* and the flow devices 127*a*-127*n* can be opened downhole by any method known in the art.

To perform a treatment operation in a particular zone, for example zone Z1, lower packer 124*a* and upper packer 124*n*+1 are set or deployed from inside the outer string by the running tool 170. Setting the upper packer 124N+1 and lower packer 124*a* anchors the outer string 120 inside the casing 104. The production zone Z1 is then isolated from all other zones. To isolate zone Z1 from the remaining zones Z2-Zn, the inner string 160 is manipulated so as to cause the opening tool 162 to open the monitoring valve 127*a* in screen S1. The inner string 160 is then manipulated (moved up and/or down) inside the outer string 120 to cause the inner string 160 to set down inside the outer string 120. When the inner string 160 is properly set inside the outer string 120, the frac port 174 is adjacent to the slurry outlet 125*a*, thereby isolating or sealing a section that contains the slurry outlet 125*a* and the frac port 174, while providing fluid communication between the inner string 160 and the slurry outlet 125*a*. The packer 124*b* is then set by the running tool 170 to isolate zone Z1. Once the packer 124*b* has been set, frac sleeve 125*a* is opened, as shown in FIG. 1, to supply slurry or another fluid to zone Z1 to perform a fracturing or a treatment operation as shown by arrows 180. Although the setting mechanism from inside a tubular is described herein with respect to a packer, the mechanism may be utilized with any other device, including, but not limited to, a sliding sleeve valve, an anchor device or any other device that utilized a movable member for operating such a device.

FIG. 2 shows a cross-section of a non-limiting embodiment of a mechanically-set packer 200 in a run-in position that may be utilized in a suitable string before deployment of the string in a wellbore, including, but not limited to, the outer string 120 shown in FIG. 1. The packer 200 includes a mandrel or body 210 with a passage 211 therethrough. The packer 200 includes a packer element section 220 and a packer setting device or section 250 around the mandrel 210. The packer element section 220 includes a packer element or pad 230 that abuts slips 240 and a sliding setting sleeve 242 placed against the slips 240. When the sleeve 242 is pushed (to the right in the configuration of FIG. 2), it causes the slips 240 to expand or move outward) and contact the casing or the wellbore as the case maybe. The slips 240 bite into the casing or the wellbore, causing the packer 200 to anchor in the casing or the wellbore. The packer element 240 expands and provides a seal between the packer and the casing of the wellbore, as the case maybe. The packer setting device 250 includes a movable packer setting member such as an outer setting sleeve 252 having an end 254 that abuts against a connection member 260 disposed between the setting sleeve 252 and the sleeve 242. The packer setting device 250 further includes one or more longitudinal or axial slots, such as slots 262*a* through 262*n* in the body 210. A separate connection member, such as a dog, connected to the inside of the outer setting sleeve 252 is slideably disposed in each axial slot. In the configuration of FIG. 2, dog 266*a* connected or attached to the inside of the setting sleeve 252 at connection 254*a* is slideably disposed in the axial slot 262*a* while dog 266*n* is similarly disposed in axial slot 262*n*.

Referring now to FIGS. 1 and 2, packer 200 may be placed in any suitable string, including, but not limited to, string 120 shown in FIG. 1 and then deployed in the wellbore. In one aspect, packers 200 are placed in the sting 120 in the run-in position as shown in FIG. 2. Once the string is deployed in the wellbore and a particular packer must be set or deployed, a running tool 280 may be run inside the string to mechanically set the packer 200 in the wellbore. In one aspect, the running tool 280 includes an attachment device 282 that may be a ring having attachments 284*a*-284*n* configured to attach to the dogs 266*a*-266*n*. The running tool is manipulated and attached to the connection device 250 via the connections 266*a*-266*n* and 284*a*-284*n*. The running tool 280 is pushed down, which causes the dogs 266*a*-266*n* to slide inside the slots 262-262*n* respectively, pushing the outer sleeve 252 to move to the right. The sleeve 252 moves the connection member 260, which causes the sleeve 242 to move to the right, causing slips 240 and the packer elements 230 to expand, thereby setting the packer 200. FIG. 3 shows the packer 200 in the deployed position, wherein the dogs 266*a*-266*n* have been moved to the right in their respective slots 262*a*-262*n* and the slips 240 have been radially moved or expanded.

In another configuration, the packer 200 shown in FIG. 2 may be deployed in the opposite direction. In such a case, the running tool 280 may be configured to set the packer 200 when the attachment members 262*a*-262*n* are pulled upward (to the left in FIG. 2). In another aspect, the attachment members 262*a*-262*n* and the running tool 280 may be configured so that the running tool 280 passes over such members so that the running tool 280 may be moved to the lowermost packer in the string. The running tool may then be pulled up to connect to the attachment members. Pulling the running tool further will cause the attachment members to move upward, causing the sleeve 242 to set the packer. In such a configuration, the packers may be sequentially set starting with the lowermost packer. In another configuration, the attachment device and the running tool may be configured to selectively attach to each other so that the packers may be set in any desired or selected order.

In aspects, the packers disclosed herein may be set with a running tool by applying force directly to an outer movable member, such as a sleeve, placed on the outside of the packer body. In one aspect, the sleeve slides along the body of the packer to set the packer element and the slips. The packer may be utilized as a liner hanger packer or as an isolation packer in the middle of a string wherein the outer side of the packer body is not accessible. In such cases, the load or force is applied to the outer sleeve to transmit a load through the packer body. As discussed above, in one aspect, the packer may utilize dogs that connect the outer sleeve to a connection device inside the packer. The dogs transmit the applied load to the outer sleeve on the outside of the packer body. The outer sleeve then transmits the load to set the packer element and the slips. In other aspects, the connection members inside the packer may have different locating mechanisms to allow for selective setting of the packers. Such mechanisms can allow for multiple tools to be deployed in the wellbore at the same time and also allow setting the packers one at a time from the bottom up as the zones are treated. The embodiments of the packer disclosed herein can provide greater inner diameter for the packer. With a given outside diameter of the packer, increasing the size of the inner diameter of the packer allows reducing or limiting the cross-sectional area outside of the packer as there is no need to set the packer from the outside. With the limited cross-section area, a mechanically-set packer is generally preferred over a hydraulically-set packer or hydrostatically-set packer due to the relatively thin profile of the mechanically-set packers. Also, the packers disclosed herein allow for the use of setting forces that are substantially greater than are achieved by piston setting tools typically used in hydraulically-set packers with the same size constraint. As noted earlier, although the concepts herein are described in reference to a packer, such concepts may equally be utilized to operate other device placed on the outside of a tubular, such as a sliding sleeve valve. The element on the outside of a valve may be a member or closure that slides over an opening to control flow of a fluid through the valve.

The foregoing disclosure is directed to certain exemplary embodiments and methods. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. An apparatus for use in a wellbore, comprising:

a body having an outer surface, a bore therethrough and a slot in the body, the slot extending along a longitudinal axis of the body;

a device on the outer surface of the body;

a setting member on the outer surface of the body that operates the device when the setting member moves against the device;

a dog connected to an inside of the setting member, wherein the dog extends from the setting member through the slot in the body; and an attachment device inside the body configured to attach to the dog inside the body, wherein the attachment device is accessible from inside of the body to enable moving the attachment device inside the body to slide the dog along the longitudinal axis of the body within the slot to move the setting member along the outer surface of the body and against the device to set the device.

2. The apparatus of claim 1, wherein the attachment device includes an attachment member that attaches to the dog.

3. The apparatus of claim 2, wherein the attachment member is accessible from inside of the body.

4. The apparatus of claim 3, wherein the attachment member is configured to attach to a running tool moving inside of the body.

5. The apparatus of claim 1, wherein the attachment device includes a plurality of attachment members, each such member slideably disposed in an axial opening in the body and accessible from inside the body for attachment to a running tool configured to move inside the body.

6. The apparatus of claim 1 further comprising a slip on an outer surface of the body movably coupled to the setting member, wherein the slip expands radially when the setting member moves the slip along the body.

7. The apparatus of claim 1, wherein the attachment device is configured to allow a running tool to pass the attachment device when the running tool moves inside the body in a first direction and engage with the running tool when the running tool moves in a second direction.

8. The apparatus of claim 1, wherein the setting member is a sliding sleeve.

9. The apparatus of claim 1, wherein the device is a packer having a packer element that expands when operated by the setting member.

10. An assembly for use in a wellbore, comprising:

a string including a plurality of sections, wherein each section includes a device and wherein each such device includes:

a body having an outer surface, a bore therethrough and a slot in the body, the slot extending along a longitudinal axis of the body;

an element on the outer surface of the body that expands radially outward from the body;

a movable sleeve on the outer surface of the body that expands the element when pushed against the element;

a dog connected to an inside of the movable sleeve and extending from the movable sleeve through the slot in the body; and an attachment device inside the body configured to attach to the dog inside the body, wherein the attachment device is accessible from inside of the body so that the attachment device is movable inside the body to slide the dog along the longitudinal axis of the body within the slot to move the movable sleeve along the outer surface to set the device.

11. The assembly of claim 10, wherein each element is a packer and the device further comprises:

a screen associated with each packer;

a slurry port for allowing a fluid to pass from an inside of the string to an outside of the string; and a flow device that allows flow of a fluid from the outside of the string to an inside of the string.

12. The assembly of claim 11 further comprising:

an outer string that includes each packer;

an inner string containing a running tool configured to attach to the attachment device of the packer to move the attachment device inside a body of the packer to move the movable sleeve to set the packer.

13. The assembly of claim 12, wherein the running tool is configured to pass each attachment device when the running tool moves in a first direction and to engage with each attachment device when the running tool moves in a second direction.

14. The assembly of claim 10, wherein the attachment device includes an attachment member that slides in an axial opening in the body.

15. The assembly of claim 10, wherein the attachment device includes a plurality of attachment members, each such member slideably disposed in an axial opening in the body and accessible from inside the body for attachment to a running tool configured to move inside the body.

16. The assembly of claim 10, wherein the element is a packer having a packer element that expands when operated by the setting member.

17. A method of performing an operation in a wellbore, comprising:

conveying an assembly in the wellbore that includes a device having a body having an outer surface, a bore therethrough and a slot in the body, the slot extending along a longitudinal axis of the body;

an element on the outer surface operable to perform a function;

a setting member on the outer surface of the body that operates the element;

a dog connected to an inside of the setting member and extending from the setting member through the slot in the body; and an attachment device configured to attach to the dog inside the body, wherein the attachment device is accessible from inside of the body to enable moving the attachment device from inside the body to slide the dog along the longitudinal axis of the body within the slot to move the setting member along the outside of the body to operate the element; and setting the device by a running tool from inside the string by moving the attachment device.

18. The method of claim 17, wherein the operation is selected from a group consisting of: a fracing operation; a sand packing operation; a flooding operation; a fracing and sand packing operation; and a production operation.

* * * * *